United States Patent [19]

Gerry

[11] 3,985,218

[45] Oct. 12, 1976

[54] LOW INERTIA IMPACT PRINTING MEANS

[76] Inventor: Martin E. Gerry, 13452 Winthrope St., Santa Ana, Calif. 92705

[22] Filed: May 16, 1975

[21] Appl. No.: 578,216

[52] U.S. Cl. ..... 197/54; 197/49

[51] Int. Cl.[2] ..... B41J 1/30

[58] Field of Search ..... 101/93.19, 93.29, 93.43, 101/93.45, 93.46, 93.48, 379; 197/18, 49, 53–55

[56] References Cited

UNITED STATES PATENTS

| | | | |
|---|---|---|---|
| 752,792 | 2/1904 | Moya | 197/54 |
| 3,117,256 | 1/1964 | Gamblin | 101/93.34 X |
| 3,389,654 | 6/1968 | Hirt | 101/35 |
| 3,543,906 | 12/1970 | Hladky | 101/93.29 X |
| 3,613,856 | 10/1971 | Reed | 197/54 |
| 3,640,369 | 2/1972 | Rolph | 197/54 |
| 3,804,009 | 4/1974 | Blume | 101/93.48 X |
| 3,842,960 | 10/1974 | Gerry | 197/53 |

OTHER PUBLICATIONS

IBM Tech. Disclosure Bulletin, W. D. Thorne, vol. 17, No. 11, Apr. 1975, pp. 3381–3382.

*Primary Examiner*—Clifford D. Crowder
*Assistant Examiner*—Paul T. Sewell

[57] ABSTRACT

In a print head, a print wheel comprising the combination of a disk, a plurality of permanently magnetized printing members bearing characters thereon, and electromagnet imparting translation to the printing members by magnetic interaction, and also providing capability of additional mechanical impact upon the printing members. The print wheel has the capability of providing means to create pulses for obtaining character selection. The wheel may be made of resilient material, preferably non-magnetic. This wheel is generally mounted on a shaft of a stepping motor, the start and stop action of the motor and character selection being controlled by logic circuits well known in the art. The motor and electromagnet are generally mounted in a movable carriage as used in a computer terminal typewriter.

12 Claims, 14 Drawing Figures

LOW INERTIA IMPACT PRINTING MEANS

CROSS-REFERENCE TO ISSUED PATENT

U.S. Pat. No. 3,842,960 issued to the same inventive entity is incorporated by reference as though fully set forth herein, for the purpose of describing and/or referring to logic systems existing in this art for character selection and stepping motor control and for providing suitable background.

INVENTION BACKGROUND

This invention is in the field of impact print heads magnetically actuated, wherein the character bearing members are permanently magnetically magnetized, and the characters are electronically selected.

Print heads are normally part of a typewriter carriage, so that when the head is actuated and a character is selected and printed the carriage is advanced to the next position for imprinting the next character.

The prior art uses print heads that are generally massive and have high inertia moments thereby slowing down the printing speed.

Other disadvantages of the prior art is that it is not possible to read the last few characters printed due to the print means causing visual obstruction.

Also existing in the prior art is a mechanically actuated print wheel, the character elements of which are activated only by an armature of a solenoid striking them. This wheel is made of metal such as steel for obtaining resiliency and is substantially heavier than any of the wheels of the instant invention due to support needed for the character elements and hence the use of relatively thick metal. The result is a much slower print action due to greater built-in inertia moments. Such prior art wheel resembles a typical wagon wheel structure except that there is no outer rim present and the spokes of the wheel each have a character at their extremities. This wheel, its spokes or that portion bearing the character is not permanently magnetized and therefore has the disadvantage of not being magnetically impelled to print the character. Such wheel may be found in typewriters identified as Model HyType I licensed for fabrication by Diablo Systems, Inc. of Hayward, Calif. to Lexitron Corporation and used in its typewriter system made under Model Videotype 92.

U.S. Pat. No. 3,842,960 issued to the same inventive entity, although overcoming some of the prior art disadvantages has print wheels which have magnetizable members radially positioned on the disk or in the flat cylinder retaining the print character bearing members, and these magnetizable members add a good deal of mass to the wheel slowing it down and making rapid stopping and starting of the stepping motor difficult. Additionally, the disk or flattened cylinder is so constructed so as to have the character face oriented orthogonally to the plane of the disk or flattened cylinder. This orientation, sets up the requirement for the magnetizable radial members to be large in size in order to hold the character bearing members when the disk is being rotated at high speed, since in these structures the character bearing members have to be rather massive.

INVENTION SUMMARY

It is therefore an objective of this system to provide a print wheel in a print head that would be structurally simple, light in weight with low moment of inertia, and have small magnetically impelled permanently magnetized members of light weight bearing characters that are oriented in the plane of the disk of the print wheel for enabling simple and rapid character translation by magnetic repulsive action.

It is a further object to provide a wheel whose disk is made of substantially solid non-magnetic resilient material so as to enable a very thin wheel to be constructed to further decrease the moment of inertia, and to be so structured so as to also magnetically impell and translate a portion thereof bearing a character.

Accordingly, a print wheel is provided comprising a disk of solid resilient material, and a plurality of permanently magnetized members retained by the disk are circumferentially disposed about the disk periphery. Each of the members have a character integral therewith, the character being positioned in a plane substantially parallel to the plane of the disk. The walls of the disk are made thin, particularly at the location of the character bearing members to reduce disk weight. Certain disks herein have concentric protrusions and depressions alternating with the protrusions in which the character bearing members are each affixed. Another disk has thin wires of magnetic material embedded. Still another disk is provided with an annular ring circumjacent its circumference for pivotably retaining the permanently magnetized character bearing members. Yet another type disk has a plurality of thin fingers of non-magnetic metallic resilient material radially disposed about the disk circumference. Each of the fingers is embossed with a character and the character backed by permanently magnetized material. All the members of these wheels bearing the characters may thus be magnetically impelled and translated by virtue of a field set up by an electromagnet that magnetically repells the selected character bearing member.

DETAILED DESCRIPTION

Figure 1:
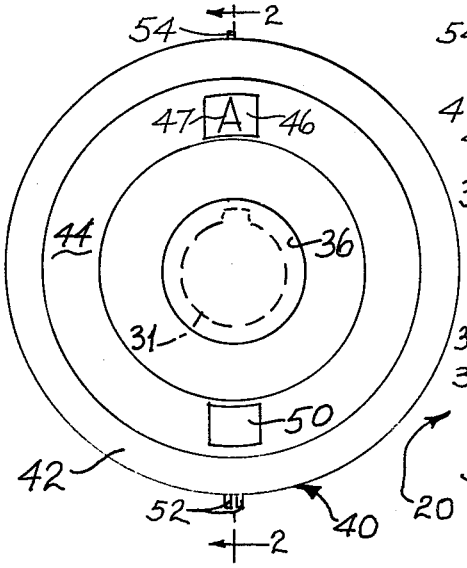
FIG. 1 is an elevation view of a character bearing wheel in accordance with this invention.
Figure 2:
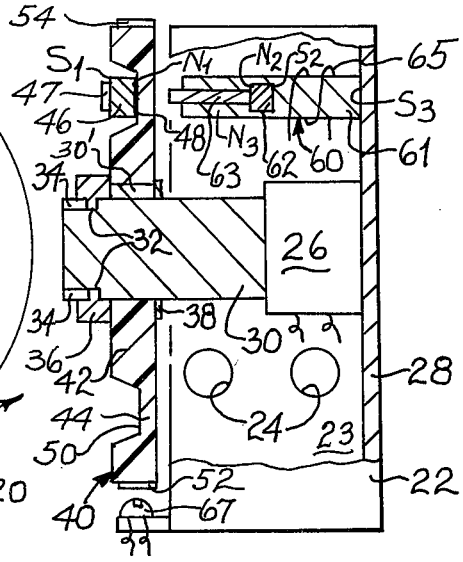
FIG. 2 is a view taken at plane 2—2 of FIG. 1 to show the character bearing wheel in cross-section, motive means for the wheel in elevation, electromagnet impact means in cross-section and magnetic sensor head in elevation, mounted in a typewriter carriage shown partly in elevation and partly in cross-section.

Referring to FIGS. 1 and 2, a print head is generally shown at 20. The control and operation of such print head has been discussed in the patent incorporated by reference herein to provide operability details of these types of print heads.

Such print heads used mostly in logic controlled typewriters as may be found in computer terminals, employs a carriage having sidewalls 22 and 23 and apertures 24 in both such sidewalls for mounting the carriage in slidable position on bars, not shown, which extend through these sidewalls and support the carriage; only apertures 24 in sidewall 23 have been shown inasmuch as sidewall 22 had been cut-away to display other components.

Stepping motor 26 provided herein and commonly used in this field of art, is mounted on rear wall 28 of the carriage. Shaft 30, driven by motor 26 when the head is in operation, has locking grooves 32 partially circumferential in shaft 30 and admitting grooves 34 for permitting tongues of lock nut 36 to be slid past admitting grooves into locking grooves 32. Rotation of lock nut 36 in a direction opposite to direction of shaft rotation will tighten the lock nut to retain a pring wheel thereon.

Shaft 30 has an annular ring 38 integral therewith to act as a stop position for print wheel 40 having a notched central opening at 31 for sliding same on shaft 30 over keyed portion of shaft 30′ corresponding to notch in opening 31, to cooperate with ring 38 and be locked in place by lock nut 36, thereby enabling the print wheel to be positioned in the same relative position on the shaft and also preventing the print wheel from slipping on the shaft surface when driven. In these figures as well as in other figures showing the print wheels, ring 38 and the peripheral surface within opening 31 may both be equally pitched at a slight angle so as to mount the print wheel where the plane of the disk therein is angularly displaced from the plane of the disk as shown in the drawings in order to enable the character bearing members to be impacted upon the platen of the typewriter with the characters tangential to the platen.

Print wheel 40 therefore generally comprises a disk of solid material as at 42 having thin wall 44 circumferentially of wheel 40 made of resilient material, generally of the same type of material as at 42, but this is not actually required since other and different materials may be used. Material for this type of use are generally resilient plastic or rubber, however, the material of wall 44 should be non-magnetic since a plurality of permanently magnetized members at 46 are attached by epoxy or molded to wall 44 at 48. Members 46 have characters such as illustrated at 47 on the face thereof, used to impact-print through a typewriter ribbon or the like on a paper sheet backed by a typewriter platen. Members 46 are permanently magnetized wherein the character face has been selected herein as the south magnetic pole $S_1$ and the junction of the thin wall and the member at 48 as the north magnetic pole $N_1$.

In these figures, it should be noted that print wheel 40 has a plurality of depressions in the wheel, or may have one continuous depression close to the disk circumference, in which permanently magnetized members 46 are affixed, except for one location as at 50 which has no character thereat. Location 50 is the zone in which counting of pulses begin, as discussed in the incorporated patent. Pulse start count for character selection is begun when a double magnetic marker 52 is sensed. All characters on the wheel, although only one character was shown for simplicity of illustration, have associated therewith a single magnetic marker as at 54, and character selection as referred to in the reference incorporated patent depends upon counting of pulses since each character has allocated to it a unique number of pulses.

Hence during operation of the print head, as wheel 40 is driven by shaft 30 when motor 26 is energized by a pulse source, and a character has been selected by depressing a particular typewriter key, counting of pulses will commence by virtue of magnetic head at 67 sensing the double pulse due to marker 52 passing said head and the circuit logic will begin counting the pulses created by passing of markers 54 past the magnetic head and stop the motor at the proper character location when the assigned number of pulses for that character has been counted, and to momentarily energize an electromagnet as at 60 thereby providing a strong magnetic field due to the electromagnet being energized so as to create magnetic poles $N_3$ and $S_3$, respectively its north and south poles, thereby repelling member 46 and stretching that part of the thin wall on which member 46 selected is positioned to translate member 46 rapidly so as to provide impact by character 47 against the typewriter platen.

Electromagnet 60 may also have an additional capability when its coil 65 is momentarily energized by the circuit logic referenced. Additional mechanical impact against the thin wall portion and member 46 may be provided by virtue of core 61 of electromagnet 60 having fixed internally therein a small permanent magnet 62, magnetically polarized north and south as shown at $N_2$ and $S_2$ respectively. In non-energized state of the electromagnet one end of translatable magnetizable armature 63 is held by and is magnetically biased by the field of magnet 62. But when the electromagnet is momentarily energized, the field represented by poles $N_3$ and $S_3$ at the respective ends of core 61, is substantially stronger than the field due to permanent magnet 62 and hence overcomes the effect of magnet 62 field to cause armature 63 to be translated from its retracted position in core 61 outward from the core against that portion of the thin wall to which selected member 46 is attached to additionally provide mechanical transfer energy upon member 46 in addition to the magnetic repulsion thereon as previously discussed, for more positive translation force acting upon the selected character bearing member.

The magnetic member selection and electromagnet activation being momentary, the current in coil 65 will be cut off, and upon completion of impact print action, member 46 will return to its normal position, armature 63 having returned to its normal position to be magnetically held by member 62, since the field defined by poles $N_3$ and $S_3$ having collapsed.

Translatable member 63 is optional inasmuch as the system could be designed to operate by creation of the field defined by poles $N_3$ and $S_3$ to overcome the permanent magnet field $N_1$ and $S_1$. In such case, neither permanent magnet 62 or movable member 63 would be required as part of electromagnet 60, and core 61 could be a bar of magnetizable material.

It should be noted that in all subsequent illustrations hereinafter discussed, the same print head 20 is employed but only a print wheel or portion thereof is illustrated and discussed. Also, it should be noted that in most instances the impacting means as at 60 or similar structure will not be discussed again wherever the same or similar structures of electromagnets are used, except for those electromagnets having special features not hereinabove discussed. Hence is will be understood that similar components including magnetic markers and sensor heads are utilized in the following to be discussed print wheels, and all such similar components discussed above and omitted in subsequent structures are incorporated therein by reference to FIGS. 1 and 2.

It should also be understood that in all illustration, only one character bearing member need be shown for simplicity of illustration, inasmuch as showing all typical characters would involve needlessly complex drawings without enhancing the disclosure constituting inventive subject matter.

Figure 3:
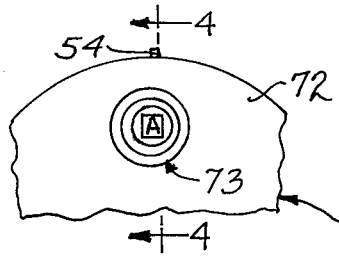
FIG. 3 is a segment of a wheel shown in elevation with concentric protrusions and depressions in which each character is affixed.
Figure 4:
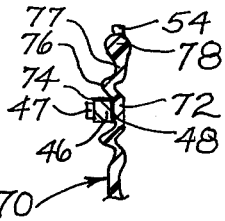
FIG. 4 is a cross-section view taken at plane 4—4 of FIG. 3.

Referring to FIGS. 3 and 4, a wheel is provided at 70, usable in a print head, having a body of solid material as at 72 which may be of thin plastic or any non-magnetizable metal. A set as at 73 of resilient concentric protrusions and depressions 74, 76 and 77, which protrusions and depressions in alternating configuration are provided in material 72, are allocated for each of the character bearing members on the disk of the print wheel. The same character bearing member 46 polarized as shown in FIG. 2, and having a character 47 on its face, is attached within each depression at 48. To provide added rigidity to such disk portion which is not required to be displaced, an annular ring of heavier non-magnetic metallic or plastic material as at 78 is provided, which ring is molded integral with disk 72 at the same time as the disk is formed. A similar heavier portion or annular ring at the mounting aperture of the disk, not shown, may be provided. Each of the magnetic markers 54 are provided and markers similar to markers 52 as in FIGS. 1 and 2 are also provided. Though not shown, it is obvious that an electromagnet as at 60 in FIG. 2 is used for translation of magnetized member 46 in similar manner as discussed in connection with FIGS. 1 and 2.

Figure 5:
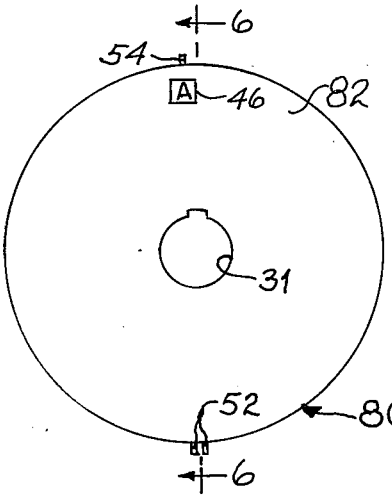
FIG. 5 is an elevation view of a wheel that employs a thin and tapered disk wall with reinforcing annular rings.
Figure 6:
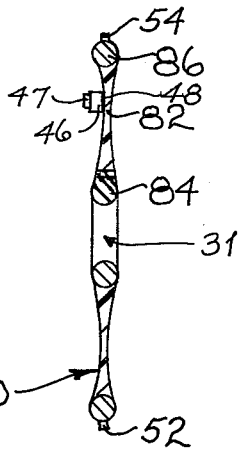
FIG. 6 is a cross-section view taken at plane 6—6 of FIG. 5.

Referring to FIGS. 5 and 6, a print wheel is provided at 80, usable in the print head, having a body or disk of solid material 82, similar to that discussed in connection with FIGS. 1 and 2.

Permanently magnetized members as exemplified by member 46, are attached at 48 about the periphery of the disk to its thinned wall portion in similar fashion as discussed in connection with FIGS. 1 and 2.

Each of members 46 is magnetically polarized as discussed in connection with FIGS. 1 and 2, and each of these members has a character as at 47 on one end thereof, so as to enable printing of such character when selected, as described in connection with FIGS. 1 and 2. For reasons already discussed, magnetic markers 52 and 54 are provided at the wheel periphery. Aperture 31 at the wheel center may be surrounded by preferably non-magnetic metallic or plastic stiffening annular ring 84 having a keway portion therein. Similarly, the outer disk periphery may have attached thereto or moded to the disk material a stiffening annular ring or member 86 of similar material as the inner annular ring. Translation of the particular character bearing member by magnetic repulsion is obtained when an electromagnet, not shown, similar to the one at 60 in FIG. 2, is momentarily energized.

Figure 7:
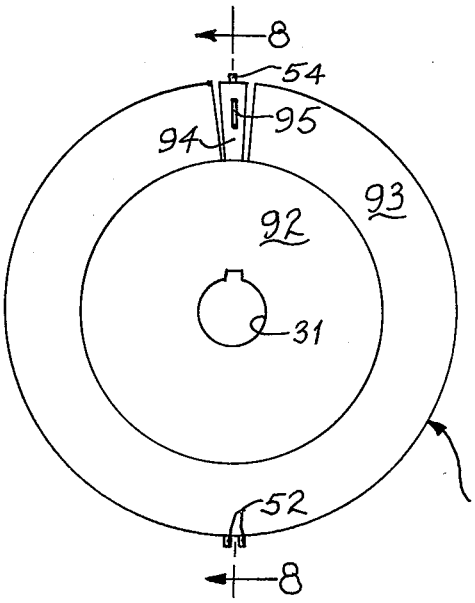
FIG. 7 is an elevation view of a wheel made of thin resilient non-magnetic material having fingers at the outer periphery thereof, the fingers having characters embossed therein and backed by permanently magnetized material.
Figure 8:
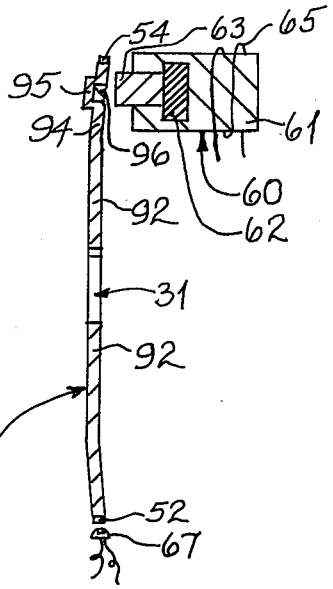
FIG. 8 is a cross-section view taken at plane 8—8 of FIG. 7.

Referring to FIGS. 7 and 8, a print wheel is shown at 90. This wheel comprises a disk 92 and fingers 94 integral with disk 92 angularly optionally displaced so that the planes of the fingers are positioned not to exceed thirty degrees with respect to the plane of the disk during inoperative mode of the wheel. Characters as at 95 are embossed in fingers 94, and such character bearing fingers are disposed about the disk circumference within area 93, so that upon impact provided by means of electromagnet 60 as discussed in connection with FIG. 2, the characters will impell tangentially upon the typewriter platen. The preferred material for disk 92 and especially for fingers 94 is beryllium-copper which is non-magnetic and has high resiliency and also provides low disk weight. Each of the fingers have permanently magnetized material 96 attached at its back surface, opposite the surface in which the embossed character makes impact upon the typewriter platen. One method of providing attachement of material 96 to back characters 95 is to fill the depressions, created by the embossing of the characters, with molten permanently magnetizable material so that such molten material fuses to the finger material when cooled, and then subjecting the entire disk to a strong magnetic field in a direction so as to provide magnetic north and south poles of similar orientation as discussed in connection with member 47 of FIG. 2. Magnetic markers 52 and 54, and magnetic sensing head 67 are provided for performing the same functions as discussed in connection with FIGS. 1 and 2. Similarly, electromagnet 60 as in FIG. 2 also performs the identical functions herein.

It can therefore be seen, that resilient fingers 92 in combination with permanently magnetized material 96 together perform the same function in the same manner as permanently magnetized member 46 which was discussed in connection with FIGS. 1 and 2.

Optionally, the entire wheel may also be tilted at a slight angle by tilting the mounting position of the driving motor, or by raising apertures 24 nearest to the print wheel slightly so as to tilt the typewriter carriage slightly, in which case fingers 94 may be made to lie in the same plane as disk 92 to effect tangential contact of the character with the platen.

Figure 9:
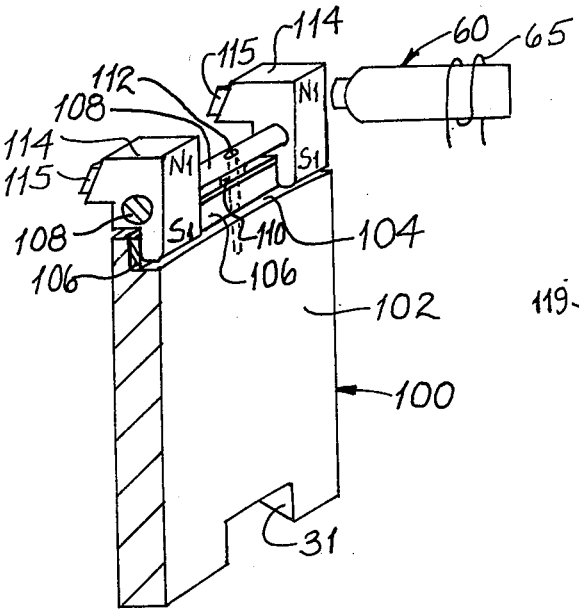
FIG. 9 is a segmentary perspective view of a wheel wherein the permanently magnetized members bearing characters are pivotably mounted at the periphery of the disk of this wheel in the same plane as the plane of the disk.
Figure 9A:
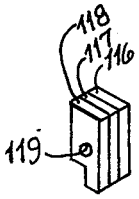
FIG. 9*a* is a perspective view of two permanently magnetized members having a non-magnetic separator between them mounted on the wheel of FIG. 9 in a similar mounting position to that of one of the character bearing members.

Referring to FIGS. 9 and 9*a*, only a segment of print wheel 100 is shown for clarity of illustration. Wheel 100 comprises disk or body 102 having central opening 31 therein, and a notch at 104 of the disk circumference. Optionally a circular ring of magnetizable material may be provided at 106, which ring is attached and held in notch 104. However, if the disk is made of material such as steel or other magnetic metal, ring 106 will not be required. Annular ring 108 circumjacent the disk periphery is provided for mounting thereon in a pivotably responsive arrangement the permanently magnetized character bearing members. Ring 108 is attached to the disk periphery by means of pins such as at 112 extending axially through the ring and into the material of disk 102 with spacer cylinders or washers 110 providing sufficient spacing between ring 108 and periphery of disk 102 to permit pivotal action of permanently magnetized character bearing members 114 mounted thereon. Members 114 each have characters 115, which characters are pitched with respect to the plane of the disk by virtue of the pitch of the face of each of members 114 on which these characters are formed, so that upon energizing of electromagnet 60 to perform the same functions as discussed in connection with FIG. 2, the north pole of member 114 is repelled by the north pole created by the electromagnet to cause members 114 to be pivoted from their magnetically biased positions. However, pitching the face of members 114 with characters thereon would not be necessary if the typewriter carriage were tilted as discussed in connection with FIGS. 7 and 8.

The lower end of members 114 having south magnetic poles are normally magnetically held either against ring 106 or against the peripheral edge of disk 102 if same is made of magnetic material. Magnetic head 67 may be positioned so as to count pulses by simply sensing the presence of the south magnetic poles $S_1$ passing thereby, and hence the pulse magnetic markers would not be required herein. As for the start to count double pulse, this may be obtained by mounting permanently magnetized assembly consisting of elements 116, 117 and 118 on ring 108 in lieu of one of the character bearing members, by passing ring 108 through aperture 119 and fusing ring 108 to elements 116–118 at that location. Elements 116 and 118 are each permanently magnetized whereas element 117 is of non-magnetic material.

Figure 10:
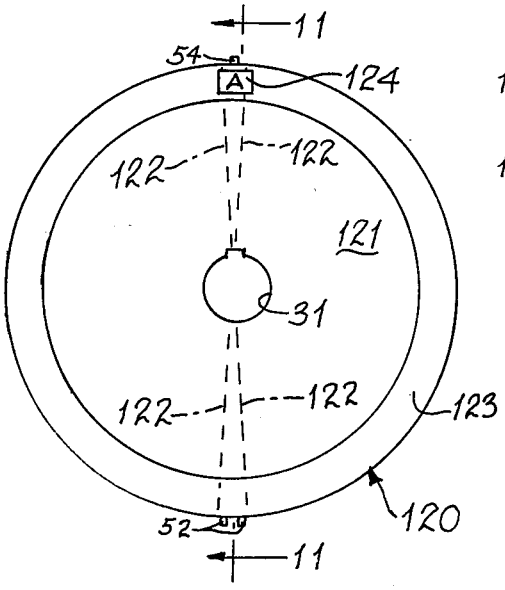
FIG. 10 is an elevation view of a wheel having a disk of non-magnetic or plastic material with magnetizable wires embedded in such material to magnetically hold the character bearing members.
Figure 11A:
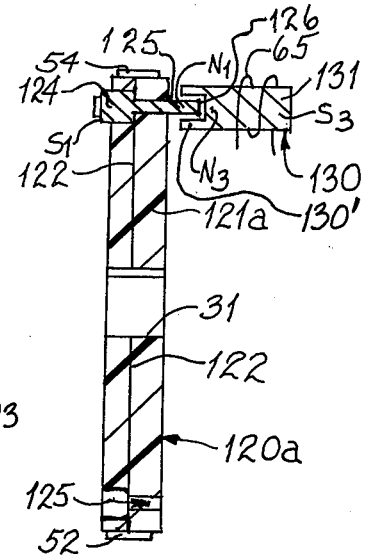
FIG. 11*a* is a cross-section view taken at plane 11—11 of FIG. 10, showing a character bearing member recessed in the disk material and extending through an aperture of the material, the character bearing member being magnetically held by means of the embedded wires. An electromagnet is used to impell the character bearing members.
Figure 11B:
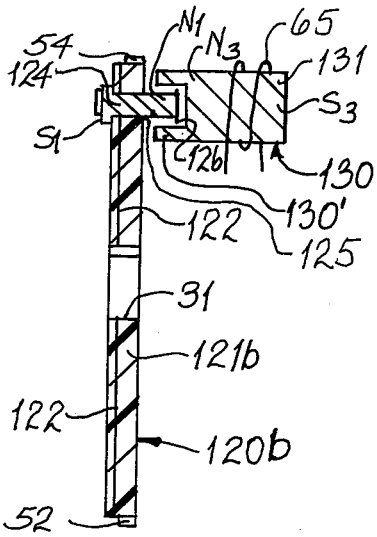
FIG. 11*b* is a cross-section view taken at plane 11—11 of FIG. 10, showing a character bearing member in the disk material, but that portion bearing the character is positioned in cooperation with the disk surface. Wires of magnetic material are embedded in the disk material to magnetically retain the character bearing member. An electromagnet is used to impell and translate the character bearing member.
Figure 11C:
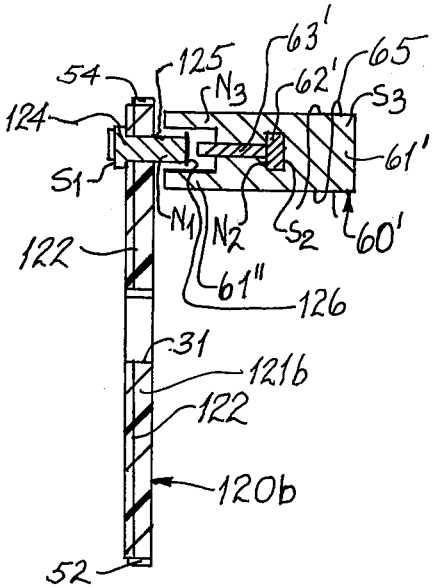
FIG. 11*c* is a cross-section view taken at plane 11—11 of FIG. 10 showing a wheel structure similar to that of FIG. 11*b*, but here the electromagnet additionally has provided a movable armature for mechanically as well as magnetically impelling the character bearing member.

Referring to FIGS. 10, 11*a*, 11*b* and 11*c*, FIG. 10 is intended to represent the elevation view of the several print wheels shown in FIGS. 11*a*, 11*b* and 11*c*. To avoid confusion, letters were used in association with the numerals of certain of the parts to show the variation, though slight, between FIGS. 11*a*, 11*b* and 11*c*.

Accordingly, print wheel 120 shows in cross-section disks 120*a* or 120*b*. These disks have a plurality of wires 122 of magnetizable material embedded in the solid non-magnetic or plastic material 12*a* or 12*b* of the disks, and radially positioned within this material. The disk material for all disks is generally shown in FIG. 10 as number 121. A plurality of apertures 125 are provided through the solid material of the disks in a direction orthogonal to the plane of the disk and spaced about its circumference at 123. Permanently magnetized members 124, each having characters at one end thereof, are magnetically held in apertures 125 by the embedded wires 122, being magnetically attracted to the magnetic material of these wires. Members 124, exhibiting south poles $S_1$ at the character bearing members near the character faces and north poles $N_1$ at ends opposite to the characters, will be repelled by the north poles created by an electromagnet as at 60′ or at 130. To prevent character bearing members 124 from accidentally being driven out of apertures 125 completely, the ends of these members may be peaned or otherwise enlarged as at 126.

The function of electromagnet 60′ and 130 is similar to that of electromagnet 60 discussed in connection with FIG. 2. However, here the cores as at 61′ and 131 respectively each have rectangular extensions 61″ and 130′ respectively. These rectangular extensions will assume magnetic poles $N_3$, as in the case of electromagnet 60 of FIG. 2, so as to repel the weaker magnetically polarized poles $N_1$ of the character bearing members during the energized modes of either of these electromagnets. Upon deenergizing of the electromagnets by removal of electrical power from coil 65, members 124 will be restored to normal by the prevailing magnetic bias due to the combination of wires 122 and members 124. Internal to core 61′ there will be present in fixed position a weak permanent magnet 62′ and a translatable armature 63′ held magnetically to magnet 62′ during the non-energized state of electromagnet 60′, so that upon energizing of electromagnet 60′ the weak poles of magnet 62′ will be overcome by the strong poles of electromagnet 60′ to enable armature 63′ to momentarily impact, mechanically, member 124. Electromagnet 130, however provides translation of member 124 by magnetic field action only.

Portions of members 124 extending through apertures 125 and apertures 125 are similarly shaped in rectangular, triangular or other keyed manner so as to inhibit rotation of these members in apertures 125. The non-magnetic disk material may also be made of Teflon, which is polymerized tetraflouro ethylene, or portions of members 124 extending through apertures 125 may be Teflon coated, or apertures 125 may have a Teflon circumference coating to assure smooth and frictionless translation of members 124. As in the case of the print wheel of FIGS. 1 and 2, magnetic markers 52 and 54 are provided as well as sensor head 67, not shown.

It is claimed:

1. In a print head, a print wheel comprising in combination:

a disk having an aperture only at its center, said disk having a wall of resilient material circumjacent the aperture, said wall being in the plane of the disk and being an integral part of said disk, said wall being thinner than other portions of the disk; and a plurality of permanently magnetized members attached to the wall, at least one of the members having a character integral therewith, said character being in a plane substantially parallel to the plane of the disk.

2. The invention as stated in claim 1, wherein said resilient material is non-magnetic.

3. The invention as stated in claim 1, wherein that portion of each of the members attached to the wall is magnetically polarized.

4. The invention as stated in claim 1, including an annular member attached to said disk, said annular member defining the disk circumference.

5. The invention as stated in claim 1, including an electromagnet and means for intermittently magnetically coupling said electromagnet to said members during operative mode of said head.

6. The invention as stated in claim 5, wherein said electromagnet includes a magnetizable armature and a permanent magnet within said electromagnet holding said armature in retracted position during non-energized state of said electromagnet, said armature impacting any one of the members selected during energized state of said electromagnet.

7. In a print head, a print wheel comprising in combination:

a disk having an aperture only at its center, wherein said disk has a plural number of sets of concentric protrusions and depressions alternating with said protrusions, said plural number of sets being of resilient material, said plural number of sets being positioned circumjacent the aperture in the plane of the disk and being an integral part of the disk; and a plurality of permanently magnetized members, one said member per set attached to the resilient material thereof, at least one of the members having a character integral therewith, said character being in a plane substantially parallel to the plane of the disk.

8. The invention as stated in claim 7, wherein each of said sets is of non-magnetic material.

9. The invention as stated in claim 7, wherein that portion of each of the members attached to the resilient material is magnetically polarized.

10. The invention as stated in claim 7, including an annular member attached to said disk, said annular member defining the disk circumference.

11. The invention as stated in claim 7, including an electromagnet and means for intermittently magnetically coupling said electromagnet to said members during operative mode of said head.

12. The invention as stated in claim 11, wherein said electromagnet includes a magnetizable armature and a permanent magnet within said electromagnet holding said armature in retracted position during non-energized state of said electromagnet, said armature impacting any one of the members selected during energized state of said electromagnet.

* * * * *